US011717044B2

(12) United States Patent
Richard

(10) Patent No.: US 11,717,044 B2
(45) Date of Patent: Aug. 8, 2023

(54) HEAD GARMENT ASSEMBLY

(71) Applicant: Clarissa Richard, Conroe, TX (US)

(72) Inventor: Clarissa Richard, Conroe, TX (US)

( * ) Notice: Subject to any disclaimer, the term of this patent is extended or adjusted under 35 U.S.C. 154(b) by 0 days.

(21) Appl. No.: 17/538,204

(22) Filed: Nov. 30, 2021

(65) Prior Publication Data

US 2023/0165334 A1 Jun. 1, 2023

(51) Int. Cl.
*A42B 1/22* (2006.01)

(52) U.S. Cl.
CPC ..... *A42B 1/225* (2013.01)

(58) Field of Classification Search
CPC ..... A42B 1/225; A42B 1/0182; A42B 1/004; A42B 1/006; A42B 1/02; A42B 1/201; A42B 1/205; A42B 1/206; A42B 1/22; A42B 3/28; A42B 3/283
USPC ..... 2/195.1, 209.3, 171.1, 171.4, 171.6; D2/876, 883, 884
See application file for complete search history.

(56) References Cited

U.S. PATENT DOCUMENTS

| | | | | | |
|---|---|---|---|---|---|
| 1,598,379 | A | * | 8/1926 | Kerr | A42B 1/205 D2/873 |
| 3,945,050 | A | * | 3/1976 | Bohash | A42C 5/04 2/195.1 |
| 5,321,854 | A | | 6/1994 | Kronenberger | |
| 5,511,249 | A | | 4/1996 | Higgins | |
| D384,190 | S | * | 9/1997 | Kellogg | A42C 5/04 D2/865 |
| 5,799,334 | A | | 9/1998 | Griffith | |
| D424,282 | S | * | 5/2000 | Crumpton | D2/882 |
| D482,849 | S | | 12/2003 | Mansell | |
| D624,286 | S | * | 9/2010 | Hall | D2/878 |
| D741,049 | S | * | 10/2015 | Etherton | D2/875 |
| 9,877,533 | B2 | | 1/2018 | Arnott | |
| D892,452 | S | * | 8/2020 | Palmer | D2/882 |
| D901,845 | S | * | 11/2020 | Chen | D2/882 |
| D910,983 | S | | 2/2021 | Chanler | |
| D913,645 | S | * | 3/2021 | Kim | D2/884 |
| D948,174 | S | * | 4/2022 | Putnam | A42B 1/205 D2/882 |
| 2003/0009813 | A1 | | 1/2003 | Dreher | |
| 2008/0092272 | A1 | * | 4/2008 | Vainio | A42B 1/225 2/209.3 |
| 2014/0082826 | A1 | | 3/2014 | Kuthari | |
| 2017/0042269 | A1 | * | 2/2017 | Lause | D04B 1/24 |
| 2019/0037952 | A1 | * | 2/2019 | Melvin | A42B 1/225 |

FOREIGN PATENT DOCUMENTS

| | | | |
|---|---|---|---|
| KR | 20130096003 A | * | 8/2013 |
| KR | 20130102319 A | * | 9/2013 |

* cited by examiner

*Primary Examiner* — Amy Vanatta

(57) ABSTRACT

A head garment assembly includes a hat that is wearable on a user's head. The hat has a plurality of first slots each extending through the hat and the user's hair can be extended through a respective one of the first slots when the user wears the hat. The first slots are distributed along a line which bisects the hat to accommodate a ponytail of the user that might be positioned at a variety of locations on a back of the user's head. The hat has a plurality of second slots each extending through the hat. Each of the second slots is laterally displaced from the line defined by the first slots to accommodate the user's ponytail when the user's ponytail is positioned on a side of the user's head.

7 Claims, 5 Drawing Sheets

HEAD GARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to head garment device and more particularly pertains to a new head garment device for facilitating a user to wear a hat in conjunction with a ponytail. The device includes a hat which has a plurality of first slots extending through the hat and being distributed along a center line of the hat. In this way a respective one of the first slots can insertably receive the user's ponytail when the ponytail is positioned at one of a variety of locations on the back of the user's head. The hat has a plurality of second slots that each extends through the hat to insertably receive the user's ponytail when the ponytail is positioned on either side of the user's head.

(2) Description of Related Art Including Information Disclosed Under 37 CFR 1.97 and 1.98

The prior art relates to head garment devices including a plurality of hat devices that each has a single opening extending through the hat for accommodating a ponytail of a user. The prior art discloses a plurality of hat devices that each includes a pair of holes, each being positioned on opposing sides of the hat, for accommodating a user's ponytail when the ponytail is worn on a side of the user's head.

BRIEF SUMMARY OF THE INVENTION

An embodiment of the disclosure meets the needs presented above by generally comprising a hat that is wearable on a user's head. The hat has a plurality of first slots each extending through the hat and the user's hair can be extended through a respective one of the first slots when the user wears the hat. The first slots are distributed along a line which bisects the hat to accommodate a ponytail of the user that might be positioned at a variety of locations on a back of the user's head. The hat has a plurality of second slots each extending through the hat. Each of the second slots is laterally displaced from the line defined by the first slots to accommodate the user's ponytail when the user's ponytail is positioned on a side of the user's head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
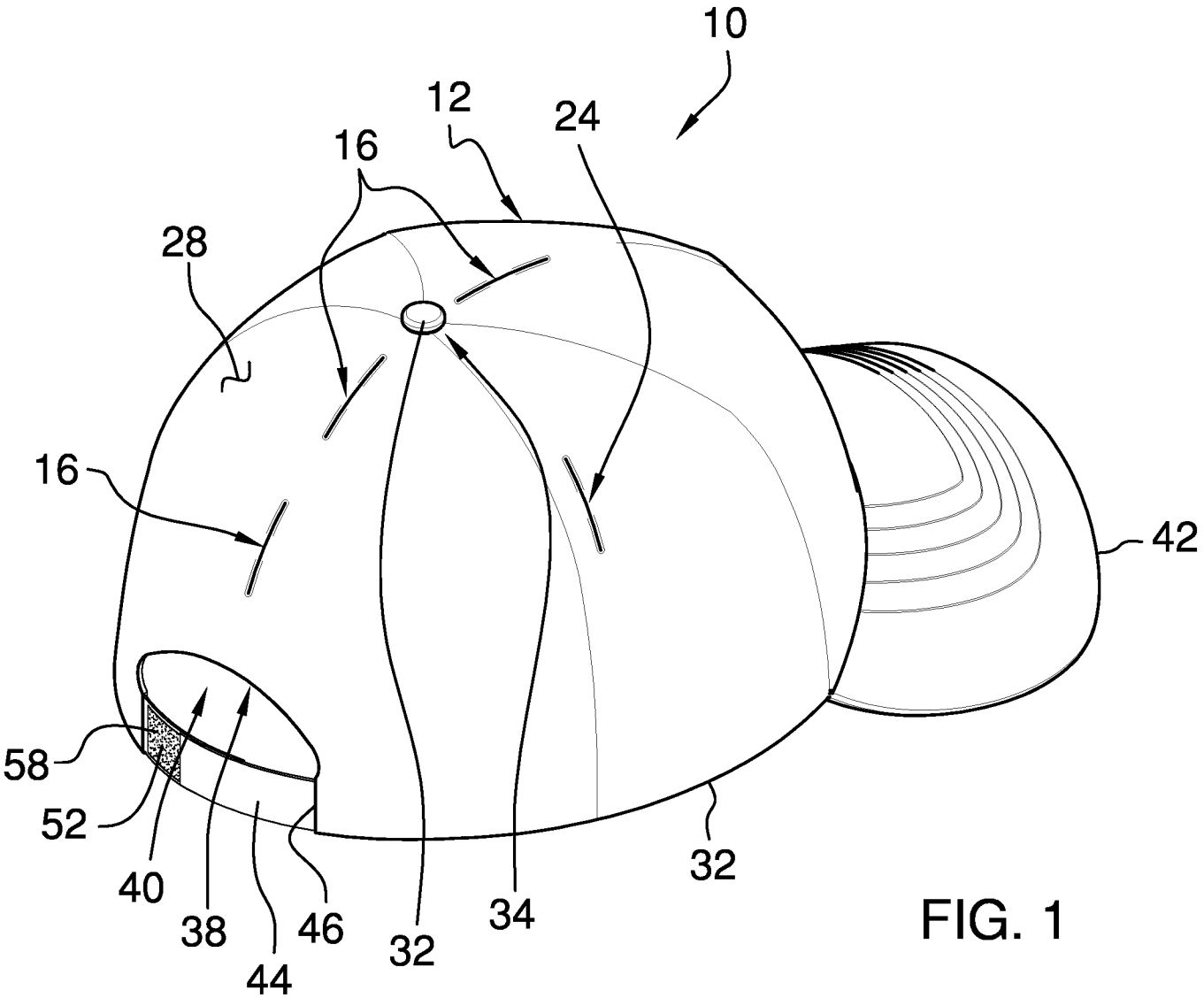
FIG. 1 is a back perspective view of a head garment assembly according to an embodiment of the disclosure.
Figure 2:
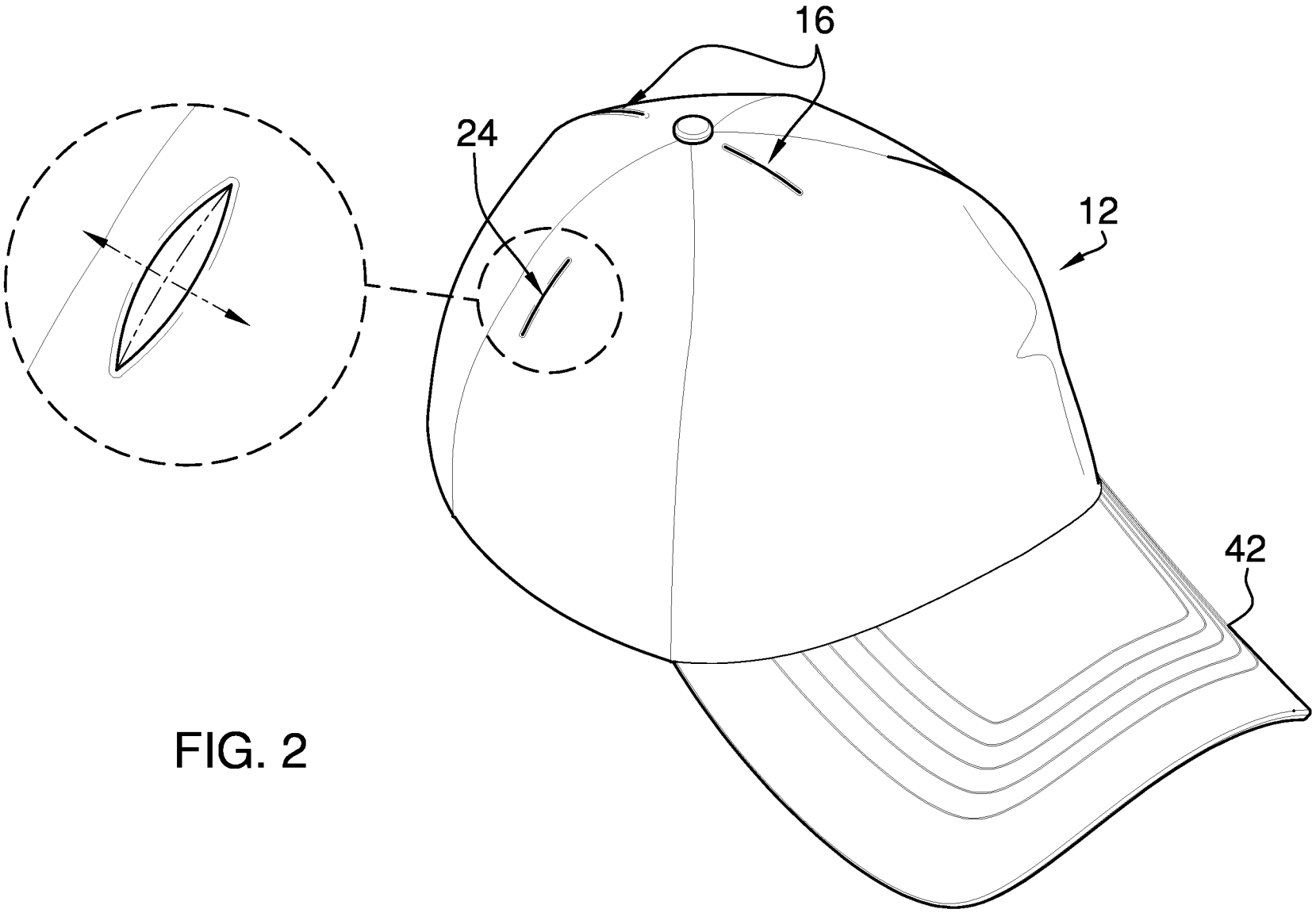
FIG. 2 is a front perspective view of an embodiment of the disclosure.
Figure 3:
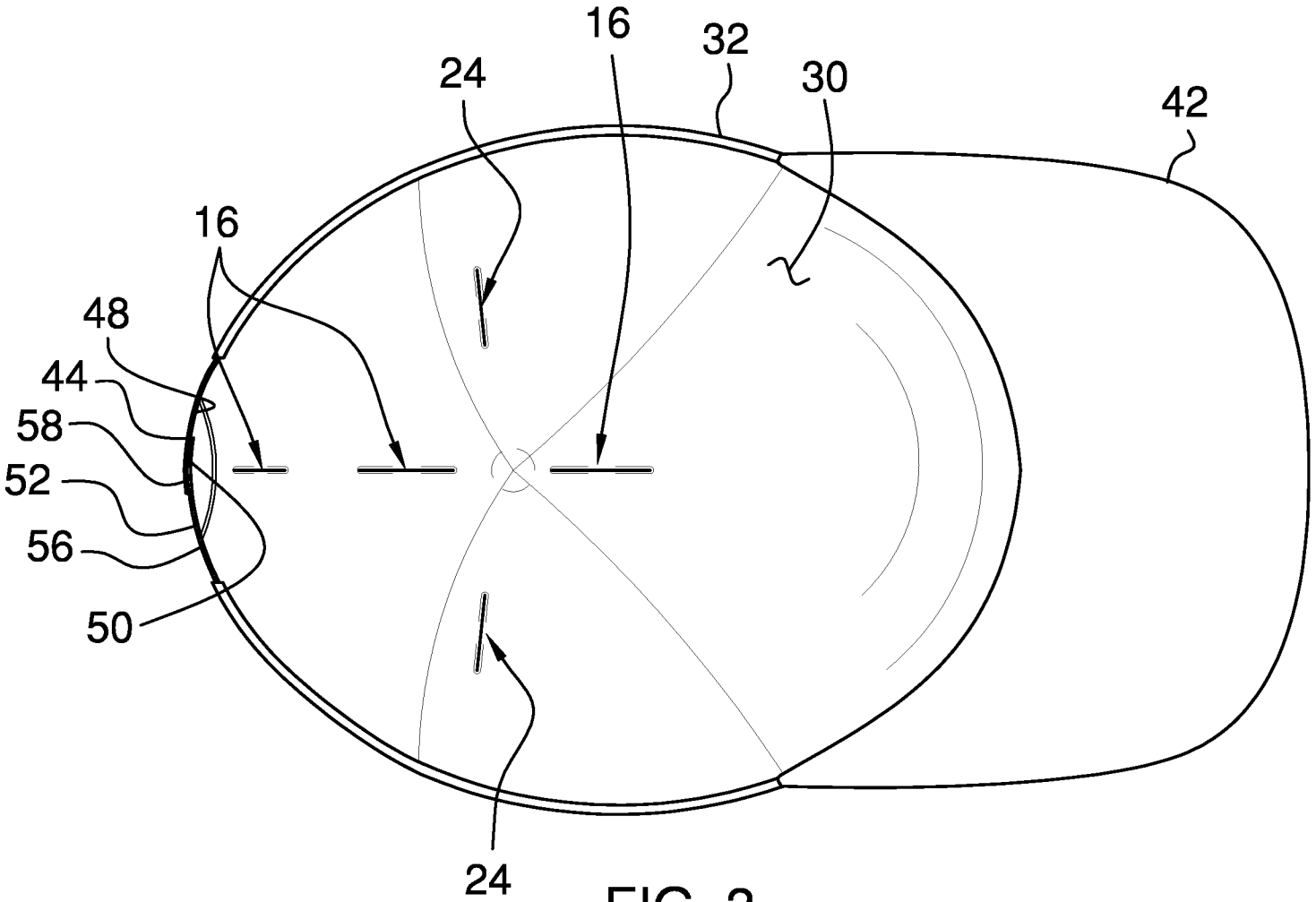
FIG. 3 is a bottom view of an embodiment of the disclosure.
Figure 5:
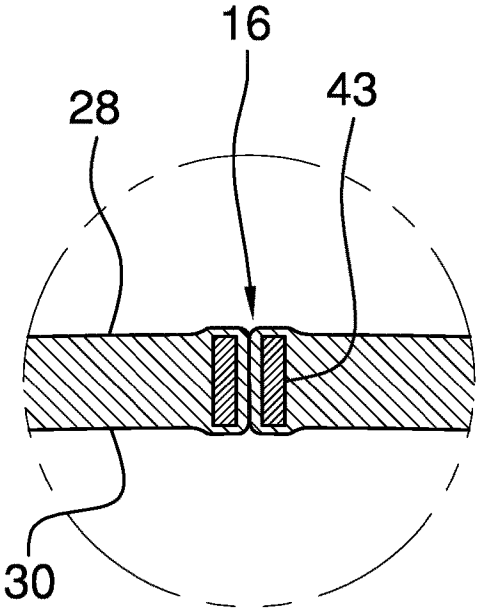
FIG. 5 is a cross sectional view taken along line 5-5 of FIG. 4 of an embodiment of the disclosure.
Figure 4:
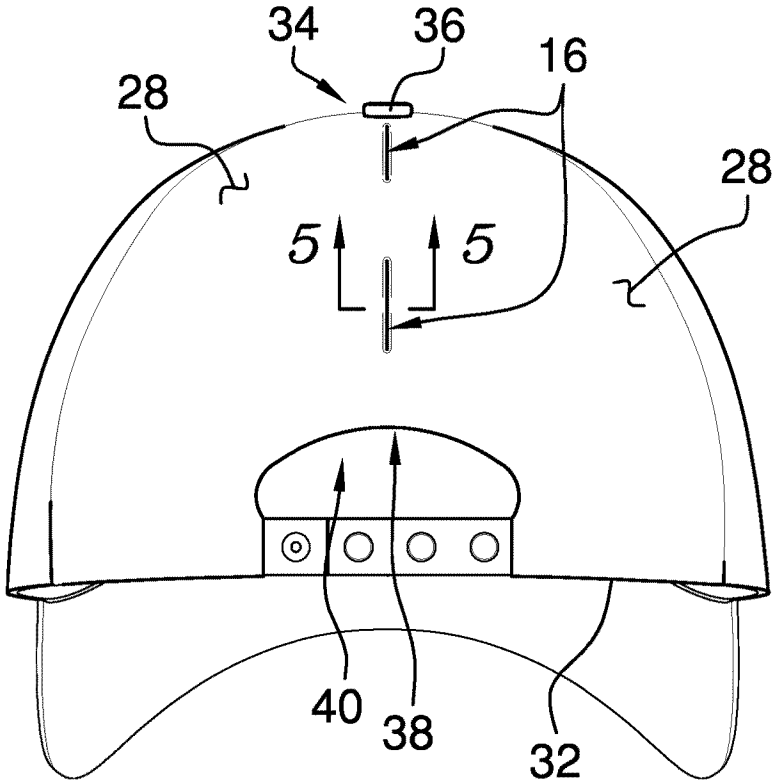
FIG. 4 is a back view of an embodiment of the disclosure.
Figure 6:
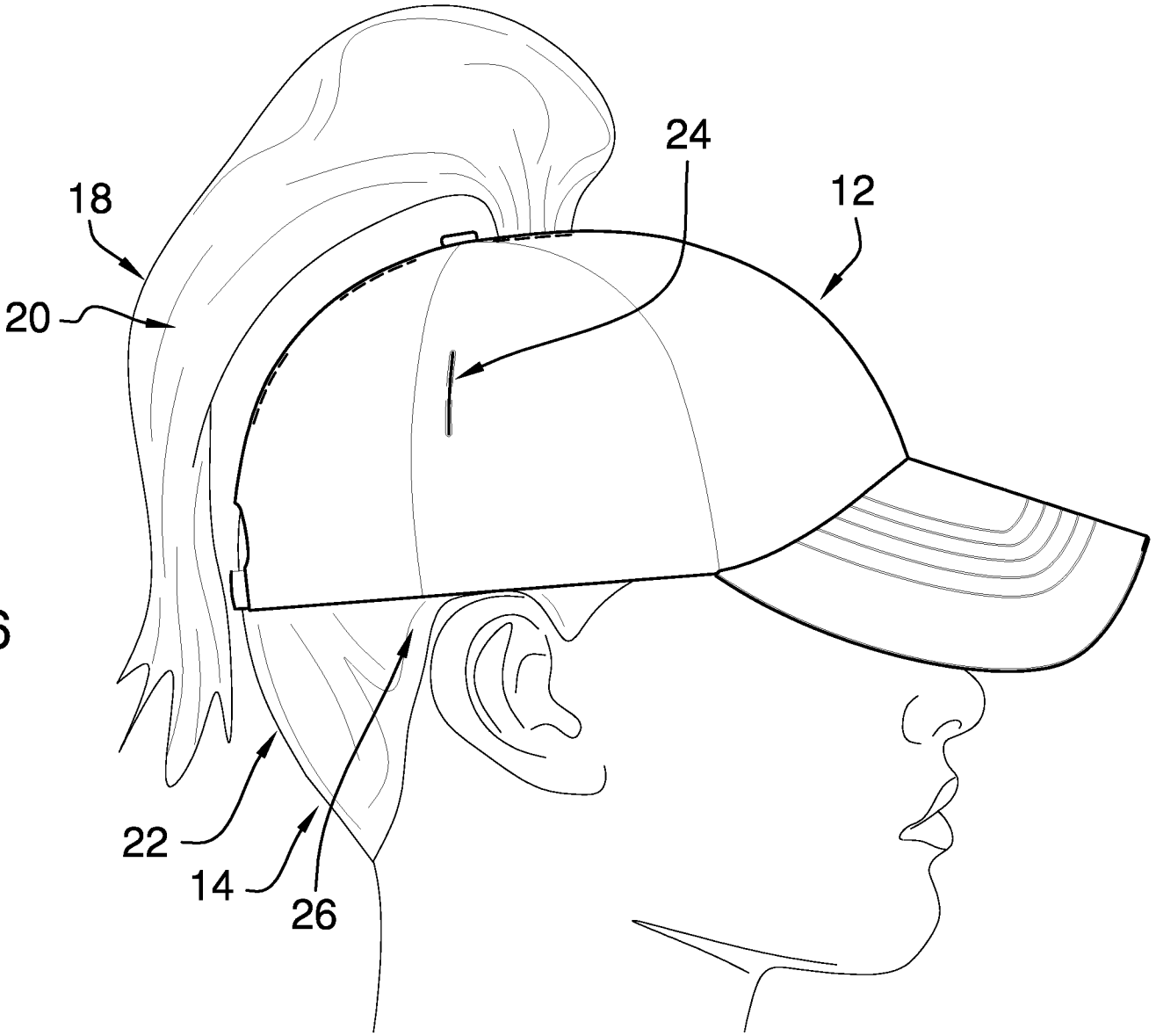
FIG. 6 is a perspective in-use view of an embodiment of the disclosure.

With reference now to the drawings, and in particular to FIGS. 1 through 6 thereof, a new head garment device embodying the principles and concepts of an embodiment of the disclosure and generally designated by the reference numeral 10 will be described.

As best illustrated in FIGS. 1 through 6, the head garment assembly 10 generally comprises a hat 12 that is wearable on a user's head 14, and the hat 12 has a plurality of first slots 16 each extending through the hat 12. The user's hair 18 can be extended through a respective one of the first slots 16 when the user wears the hat 12. In this way the user's comfort is enhanced when wearing the hat 12 while user has a ponytail 20, for example. The first slots 16 are distributed along a line which bisects the hat 12. In this way the plurality of first slots 16 can accommodate a ponytail 20 of the user that might be positioned at a variety of locations on a back 22 of the user's head 14. The hat 12 has a plurality of second slots 24 each extending through the hat 12. Each of the second slots 24 is laterally displaced from the line defined by the first slots 16. In this way each of the second slots 24 can accommodate the user's ponytail 20 when the user's ponytail 20 is positioned on a side 26 of the user's head 14.

The hat 12 has a top surface 28, a bottom surface 30 and a perimeter edge 32 extending between the top surface 28 and the bottom surface 30, and the perimeter edge 32 is continuous such that the hat 12 has a circular shape. The bottom surface 30 is concavely arcuate with the perimeter edge 32 such that the hat 12 defines a bowl to conform to the shape of the user's head 14. The top surface 28 is co-arcuate with the bottom surface 30 and the top surface 28 has an apex 34. A button 36 is coupled to the top surface 28 and the button 36 is positioned at the apex 34.

The perimeter edge 32 has a concave portion 38 extending upwardly toward the apex 34 to define an arch 40 in the perimeter edge 32. Additionally, the arch 40 is positioned on a back of the user's head 14 when the hat 12 is worn. The line which bisects the hat 12 extends between the arch 40 in the perimeter edge 32 and the apex 34, and each of the first slots 16 is elongated to extend along the line. A brim 42 is coupled to and extends laterally away from the perimeter edge 32 and the brim 42 is positioned on an opposite side of the hat 12 from the arch 40 defined by the concave portion 38 of the perimeter edge 32. Respective ones of the first slots 16 are spaced apart from each other and are distributed between the arch 40 and the button 36, and a respective one of the first slots 16 is positioned between the button 36 and the brim 42.

Each of the second slots 24 is elongated to extend along an axis that is perpendicularly oriented to the line bisecting the hat 12. Each of the second slots 24 is centrally positioned between the line bisecting the hat 12 and the perimeter edge 32. Additionally, each of the second slots 24 is centrally positioned between the brim 42 and the arch 40 defined by the concave portion 38 of the perimeter edge 32. The hat 12 is comprised of a resiliently stretchable material such that each of the first slots 16 and the second slots 24 can be stretched around the user's ponytail 20. As is most clearly shown in FIG. 5, each of the first slots 16 and the second slots 24 may be bounded by an elastomeric band 43 for enhancing opening and closing the first slots 16 and the second slots 24.

A first strap 44 is coupled to the perimeter edge 32 of the hat 12 and the first strap 44 is positioned on a first lateral side 46 of the arch 40 defined by the concave portion 38 of the perimeter edge 32. The first strap 44 has a first surface 48 and a first mating member 50 is coupled to the first surface 48 of the first strap 44. A second strap 52 is coupled to the perimeter edge 32 of the hat 12 and the second strap 52 is positioned on a second lateral side 54 of the arch 40 defined by the concave portion 38 of the perimeter edge 32. The second strap 52 has a primary surface 56 and a second mating member 58 is coupled to the primary surface 56 of the second strap 52. The second mating member 58 is matable to the first mating member 50 to adjust a size of the hat 12 to accommodate a variety of sizes of heads. Each of the first mating member 50 and the second mating member 58 may comprise complementary portions of a hook and loop fastener or the like.

In use, the user wears the hat 12 on their head 14 and the user extends their ponytail 20 outwardly through a respective one of the first slots 16 or the second slots 24, depending on where the ponytail 20 is positioned on the user's head 14. In this way the hat 12 facilitates the user to comfortably wear the hat 12 regardless of where the user's ponytail 20 is positioned on the user's head 14. Thus, the hat 12 accommodates the user's ponytail 20 when the ponytail 20 is positioned on the back of the user's head 14 or on either side of the user's head 14. Additionally, the resiliently stretchable nature of the hat 12 facilitates the respective first slot 16 or second slot 24 to be easily stretched open to enhance extending the ponytail 20 through the respective first slot 16 or second slot 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A head garment assembly for accommodating hair styles with a ponytail, said assembly comprising:

a hat being wearable on a user's head, said hat having a plurality of first slots each extending through said hat wherein each of said first slots is configured to have the user's hair being extended through a respective one of said first slots when the user wears said hat, said first slots being distributed along a line which bisects said hat wherein said plurality of first slots is configured to accommodate a ponytail of the user being positioned at a variety of locations on a back of the user's head, said hat having a plurality of second slots each extending through said hat, each of said second slots being laterally displaced from said line defined by said first slots wherein each of said second slots is configured to accommodate the user's ponytail when the user's ponytail is positioned on a side of the user's head;

wherein said hat has a top surface, a bottom surface and a perimeter edge extending between said top surface and said bottom surface, said perimeter edge being continuous such that said hat has a circular shape, said bottom surface being concavely arcuate with said perimeter edge such that said hat defines a bowl wherein said hat is configured to conform to the shape of the user's head, said top surface being co-arcuate with said bottom surface, said top surface having an apex;

wherein said hat having a button being coupled to said top surface, said button being positioned at said apex;

wherein said perimeter edge has a concave portion extending upwardly toward said apex to define an arch in said perimeter edge wherein said arch is configured to be positioned on a back of the user's head when said hat is worn, said line bisecting said hat extending between said arch in said perimeter edge and said apex; and wherein each of said first slots being elongated to extend along said line.

2. The assembly according to claim 1, wherein:

said hat has a brim being coupled to and extending laterally away from said perimeter edge, said brim being positioned on an opposite side of said hat from said arch defined by said concave portion of said perimeter edge;

respective ones of said first slots being spaced apart from each other and being distributed between said arch and said button; and a respective one of said first slots being positioned between said button and said brim.

3. The assembly according to claim 1, wherein each of said second slots is elongated to extend along an axis being perpendicularly oriented to said line bisecting said hat, each of said second slots being centrally positioned between said line bisecting said hat and said perimeter edge, each of said second slots being centrally positioned between said brim and said arch defined by said concave portion of said perimeter edge.

4. The assembly according to claim 1, wherein said hat is comprised of a resiliently stretchable material wherein each of said first slots and said second slots is configured to be stretched around the user's ponytail.

5. The assembly according to claim 1, further comprising:

a first strap being coupled to said perimeter edge of said hat, said first strap being positioned on a first lateral side of said arch defined by said concave portion of said perimeter edge, said first strap having a first surface; and a first mating member being coupled to said first surface of said first strap.

6. The assembly according to claim 5, further comprising:

a second strap being coupled to said perimeter edge of said hat, said second strap being positioned on a second lateral side of said arch defined by said concave portion of said perimeter edge, said second strap having a primary surface; and a second mating member being coupled to said primary surface of said second strap, said second mating member being matable to said first mating member to adjust a size of said hat wherein said first strap and said second strap is configured to accommodate a variety of sizes of heads.

7. A head garment assembly for accommodating hair styles with a ponytail, said assembly comprising:

a hat being wearable on a user's head, said hat having a plurality of first slots each extending through said hat wherein each of said first slots is configured to have the user's hair being extended through a respective one of said first slots when the user wears said hat, said first slots being distributed along a line which bisects said hat wherein said plurality of first slots is configured to accommodate a ponytail of the user being positioned at a variety of locations on a back of the user's head, said hat having a plurality of second slots each extending through said hat, each of said second slots being laterally displaced from said line defined by said first slots wherein each of said second slots is configured to accommodate the user's ponytail when the user's ponytail is positioned on a side of the user's head, said hat having a top surface, a bottom surface and a perimeter edge extending between said top surface and said bottom surface, said perimeter edge being continuous such that said hat has a circular shape, said bottom surface being concavely arcuate with said perimeter edge such that said hat defines a bowl wherein said hat is configured to conform to the shape of the user's head, said top surface being co-arcuate with said bottom surface, said top surface having an apex, said hat having a button being coupled to said top surface, said button being positioned at said apex, said perimeter edge having a concave portion extending upwardly toward said apex to define an arch in said perimeter edge wherein said arch is configured to be positioned on a back of the user's head when said hat is worn, said line bisecting said hat extending between said arch in said perimeter edge and said apex, each of said first slots being elongated to extend along said line, said hat having a brim being coupled to and extending laterally away from said perimeter edge, said brim being positioned on an opposite side of said hat from said arch defined by said concave portion of said perimeter edge, respective ones of said first slots being spaced apart from each other and being distributed between said arch and said button, a respective one of said first slots being positioned between said button and said brim, each of said second slots being elongated to extend along an axis being perpendicularly oriented to said line bisecting said hat, each of said second slots being centrally positioned between said line bisecting said hat and said perimeter edge, each of said second slots being centrally positioned between said brim and said arch defined by said concave portion of said perimeter edge, said hat being comprised of a resiliently stretchable material wherein each of said first slots and said second slots is configured to be stretched around the user's ponytail;

a first strap being coupled to said perimeter edge of said hat, said first strap being positioned on a first lateral side of said arch defined by said concave portion of said perimeter edge, said first strap having a first surface;

a first mating member being coupled to said first surface of said first strap;

a second strap being coupled to said perimeter edge of said hat, said second strap being positioned on a second lateral side of said arch defined by said concave portion of said perimeter edge, said second strap having a primary surface; and a second mating member being coupled to said primary surface of said second strap, said second mating member being matable to said first mating member to adjust a size of said hat wherein said first strap and said second strap is configured to accommodate a variety of sizes of heads.

* * * * *